US009561482B1

(12) United States Patent
Harris et al.

(10) Patent No.: US 9,561,482 B1
(45) Date of Patent: Feb. 7, 2017

(54) STATIC MIXER ASSEMBLY SUITABLE FOR USE WITH INJECTED GAS IN SCR AND/OR OTHER APPLICATIONS

(71) Applicants: Paul Harris, Canton, MI (US); Robert Mudry, Plymouth, MI (US); Peikang Jin, Belle Mead, NJ (US)

(72) Inventors: Paul Harris, Canton, MI (US); Robert Mudry, Plymouth, MI (US); Peikang Jin, Belle Mead, NJ (US)

(73) Assignee: MITSUBISHI HITACHI POWER SYSTEMS AMERICAS, INC., Basking Ridge, NJ (US)

( * ) Notice: Subject to any disclaimer, the term of this patent is extended or adjusted under 35 U.S.C. 154(b) by 0 days.

(21) Appl. No.: 14/048,380

(22) Filed: Oct. 8, 2013

(51) Int. Cl.
*B01F 5/06* (2006.01)

(52) U.S. Cl.
CPC ..... *B01F 5/0602* (2013.01)

(58) Field of Classification Search
CPC ..... B01F 5/0451; B01F 5/0456; B01F 5/0618; B01F 2005/0627; B01F 2005/0638; B01F 5/0602
USPC ..... 366/177.1, 181.5, 336, 173.2, 174.1,366/175.2
See application file for complete search history.

(56) References Cited

U.S. PATENT DOCUMENTS

| | | | | |
|---|---|---|---|---|
| 4,527,903 | A | 7/1985 | Ruschewyh | |
| 5,489,153 | A | 2/1996 | Berner et al. | |
| 5,749,651 | A * | 5/1998 | Huttenhofer | B01D 53/8631 366/181.5 |
| 6,623,155 | B1 * | 9/2003 | Baron | B01F 5/0611 366/181.5 |
| 7,547,134 | B2 | 6/2009 | Hansen | |
| 2011/0174408 | A1 * | 7/2011 | Lundberg | B01F 5/0616 138/39 |
| 2013/0298996 | A1 * | 11/2013 | Tabikh et al. | 137/1 |

* cited by examiner

*Primary Examiner* — Tony G Soohoo
*Assistant Examiner* — Elizabeth Insler
(74) *Attorney, Agent, or Firm* — Michael P. Straub; Ronald P. Straub; Stephen T. Straub

(57) ABSTRACT

A static mixer is described in which rows of mixing plates are used in a combination with nozzles that are located with respect to the mixing plates in a manner that is designed to produce a high level of mixing without significantly impeding the flow of flue gas passing through the rows of mixer plates. In various embodiments, the static mixer includes rows of tilted plates, and the injection lance nozzles are positioned to align with row boundaries corresponding to the boundaries between consecutive rows of mixing plates. In some embodiments, there are N rows of mixing plates and N-1 rows of nozzles. In some embodiments the nozzles are positioned to coincide with the boundaries between rows. The mixer assembly including injection nozzles and/or lances can be implemented in a relatively compact manner allowing for it to be placed in a shorter length of flue than many other mixer assemblies.

20 Claims, 11 Drawing Sheets

STATIC MIXER ASSEMBLY SUITABLE FOR USE WITH INJECTED GAS IN SCR AND/OR OTHER APPLICATIONS

FIELD OF INVENTION

The present invention relates to mixing devices, and more particularly, to static mixers which are well suited for use in flues where it may be desirable to mix a gaseous reagent with flue gas as it passes through the flue.

BACKGROUND

Many electric power plants burn fossil fuels such as coal or natural gas in order to generate electricity. In the combustion process, various undesirable products are created including nitrous oxides (NOx), sulfur oxides (SOx), mercury (Hg), and particulate material (coal ash). These pollutants must be removed from the combustion gas stream to levels below those prescribed by the Environmental Protection Agency (EPA) before the "cleansed" gas is emitted from the plant stack. Various types of pollution control equipment are used to remove these chemical compounds and particulate. One such system is the Selective Catalytic Reactor (SCR), which removes the NOx from the gas stream through a catalytic reaction Ammonia (NH3) is injected into the NOx-laden gas stream and a reducing reaction occurs through the catalyst, converting the NOx to nitrogen (N2) and water vapor (H2O).

The design of an SCR system to reduce NOx emissions from these plants involves a number of engineering disciplines including chemical, mechanical, fluid dynamic, and structural engineering. With respect to the fluid dynamic design, there are a number of flow-related parameters that need to be addressed in order to optimize the SCR performance. It is vital to achieve a uniform distribution of velocity, temperature, NOx, and NH3 through the catalyst material while also minimizing the system pressure losses. Unfortunately, these goals often work counter to each other. For example, attaining uniform, streamlined velocity patterns and low pressure drop requires an aerodynamic design of the ductwork that conveys the gases from the combustion zone (the boiler) to the SCR. Aerodynamic elements, such as turning vanes, flow straighteners, and other devices are used to provide a smooth, controlled flow stream. This runs counter, however, to the requirement for uniform temperature, NOx, and NH3. These parameters benefit from turbulent, chaotic mixing of the gas species, so static mixing devices are often inserted into the gas stream to homogenize the flow.

Thus, an optimally-designed system requires a careful balance of these competing flow-related goals. In particular, the industry has found it challenging to mix the gaseous species of NOx and NH3 sufficiently without creating an adverse effect on the gas velocity uniformity and/or pressure drop. Static mixers are frequently used to induce the turbulence and the mixing action. Some mixers do this by creating a swirl or a rotational vortex. Other mixers divide the flow and angle it in different directions, resulting in shear layers where turbulent mixing occurs. All of these mixing concepts tend to cause the velocity patterns to become misaligned with the primary flow direction, generating angular or swirling flow vectors. This can have a negative impact on the other primary goal of achieving a smooth, uniform velocity distribution with no angular vector as the flow enters the catalyst. Thus, these types of mixers can require long distances for the flow to smooth out, or they require additional flow control devices (adding to cost and pressure drop) to re-align and distribute the flow. Some of these mixers are also overly-sensitive such that subtle changes to incoming flow conditions (i.e., NH3 injection locations or incoming NOx profile from the boiler) result in significantly different mixing behavior.

Though there are a number of different static mixers that have been developed for SCRs, they tend to fit into one of two categories based on the fluid-dynamic behavior that they induce, i.e., shear mixers and vortex mixers. Many shear mixers redirect flue gas in a manner that alters the flow significantly from its original direction thereby promoting significant angular velocity components that are not aligned with the duct direction. These flow angles can persist and may result in a non-uniform velocity distribution downstream of the static mixer at the catalyst. Unless the ducts have long lengths for the flow to redistribute, additional flow devices will be needed to control the flow and obtain the required velocity profile at the catalyst.

Also many, but not all, shear mixers generate shear in only one direction (i.e., length-wise of the duct cross section) as a primary focus. Often, a second mixer is required to promote shear in the other duct direction (i.e., width-wise). The need for multiple mixers to insure adequate mixing can require a relatively long length to ensure a proper level of mixing is achieved.

In addition to shear mixers, there are "vortex mixers". Vortex mixers induce rotational eddies and vortices. These are often large plates or other bluff bodies located in the gas stream to block the flow and divert it. A large wake is created by these plates and thus a low pressure region exists on the downstream side. The NH3 is generally injected into this wake, downstream of the mixer, and the eddies created by the vortices induce NH3 mixing. This can provide quite reasonable NH3 and NOx mixing for SCR systems, but because of their nature the vortex mixers do not allow for much adjustability, or tuning of the NH3 if it is needed. Vortex mixers can also be sensitive to incoming flow conditions but have no mechanism which would allow for easy system adjustments.

For static mixers to perform well, meeting the ammonia and NOx mixing objectives, temperature mixing objectives, and pressure drop objectives often associated with SCR systems while avoiding negative influences on velocity distribution or angularity is highly desirable. In SCR systems such objectives have to be accomplished under what are often rather adverse conditions including the presence of erosive particulate in the flow stream (especially for coal-fired power plants), elevated temperatures, and varied incoming conditions (such as gas flow rate or NOx profile from the boiler). To be practical, in addition to meeting the functional objectives, static mixers should also be affordable and reasonably easy to install and maintain.

Thus it should be appreciated, that there is a need for new mixing devices which balance the competing flow-related goals of mixing one or more reagents with a gas flow, e.g., flue gas flow, without significantly impeding the flow while still achieving a desirable level of mixing.

SUMMARY

A static mixer is described in which rows of mixing plates are used in a combination with nozzles that are located with respect to the mixing plates in a manner that is designed to produce a high level of mixing without significantly impeding the flow of flue gas passing through the rows of mixer plates. The rows of plates are welded together and/or supported by structural beams and/or pipes within a flue. While many fixed plate embodiments are contemplated, in at least some embodiments mixing plates are mounted in a manner that allows them to pivot changing the angle of the plates and thus the amount of mixing induced by the plates.

Various newly-developed flow mixing devices target the various above discussed plurality of flow-related goals, e.g., attaining uniform, streamlined velocity patterns, having a low pressure drop, achieving a uniform distribution of velocity, achieving a uniform distribution of temperature, achieving a uniform distribution of NOx, and achieving a uniform distribution of NH3. Thus, a new flow mixing device offers a novel solution that is well suited for SCR systems on power plants and other industrial facilities. An exemplary flow mixing device includes: 1) a static mixer that induces shear forces and turbulence in two directions (length-wise and width-wise in a rectangular duct) while still maintaining the bulk flow vector in alignment with the duct direction, and 2) a grid of gaseous injection lances with one or more nozzles per lance, located upstream of the static mixer. The combination of these two elements results in well-mixed gas species of NOx and NH3 over the duct cross section while keeping the velocity patterns aligned with the ductwork. The pressure drop caused by the exemplary newly-developed flow mixing device is, in at least some embodiments, on the same level or less than other, existing mixing systems while the mixer provides a highly desirable level of mixing in a relatively short distance. Thus, the static mixer can be implemented with a shorter overall length and less material than other mixers requiring a greater distance between nozzles and other mixer components such as mixer plates. This leads to cost benefits as compared to other designs and allows the compact mixer to be used in locations where other mixers requiring a longer overall length may not be able to be installed.

In various embodiments, the static mixer includes rows of tilted plates, and the injection lance nozzles are positioned to align with row boundaries corresponding to the boundary between consecutive rows of mixing plates. In some embodiments, there are N rows of mixing plates and N-1 rows of nozzles with the nozzles being positioned to coincide with the boundaries between rows.

Preferably, in at least some embodiments, the nozzles are positioned so that in addition to injecting at a row boundary, the injection point of individual nozzles correspond to locations where the plates of two consecutive mixing rows cross. Thus the injection occurs in a region of high turbulence, with a highly desirable resultant mixing.

An exemplary mixer assembly, in accordance with some embodiments, includes: a duct configured to pass flue gas in a first direction; a plurality of rows of mixing plates in said duct, each row of mixing plates extending in a second direction in said duct, said second direction being perpendicular to said first direction, mixing plate row boundaries occurring in a third direction extending perpendicular to said first and second directions; and a plurality of gas injection nozzles, positioned upstream of said rows of mixing plates, said nozzles being arranged in rows which are aligned in said third direction with said row boundaries.

While the static mixer is a shear type mixer, it is unlike many other SCR shear mixers. The static mixer utilizes an alternating strategy such that shear is promoted in both directions over the cross section simultaneously (length-wise and width-wise). The static mixer including lances can be implemented in a relatively short length of flue and can achieve a desirable level of mixing in many applications without significantly impeding flue gas flow.

The static mixer is not of the vortex mixer type, and thus does not create the same type of fluid dynamic behavior. Furthermore, in the moveable plate embodiments, the ability to vary the angle of the mixing plates allows for a large degree of flexibility allowing for tuning after deployment in a system.

While various embodiments have been discussed in the summary above, it should be appreciated that not necessarily all embodiments include the same features and some of the features described above are not necessary but can be desirable in some embodiments. Numerous additional features, embodiments, and benefits of various embodiments are discussed in the detailed description which follows.

DETAILED DESCRIPTION

Figure 1:
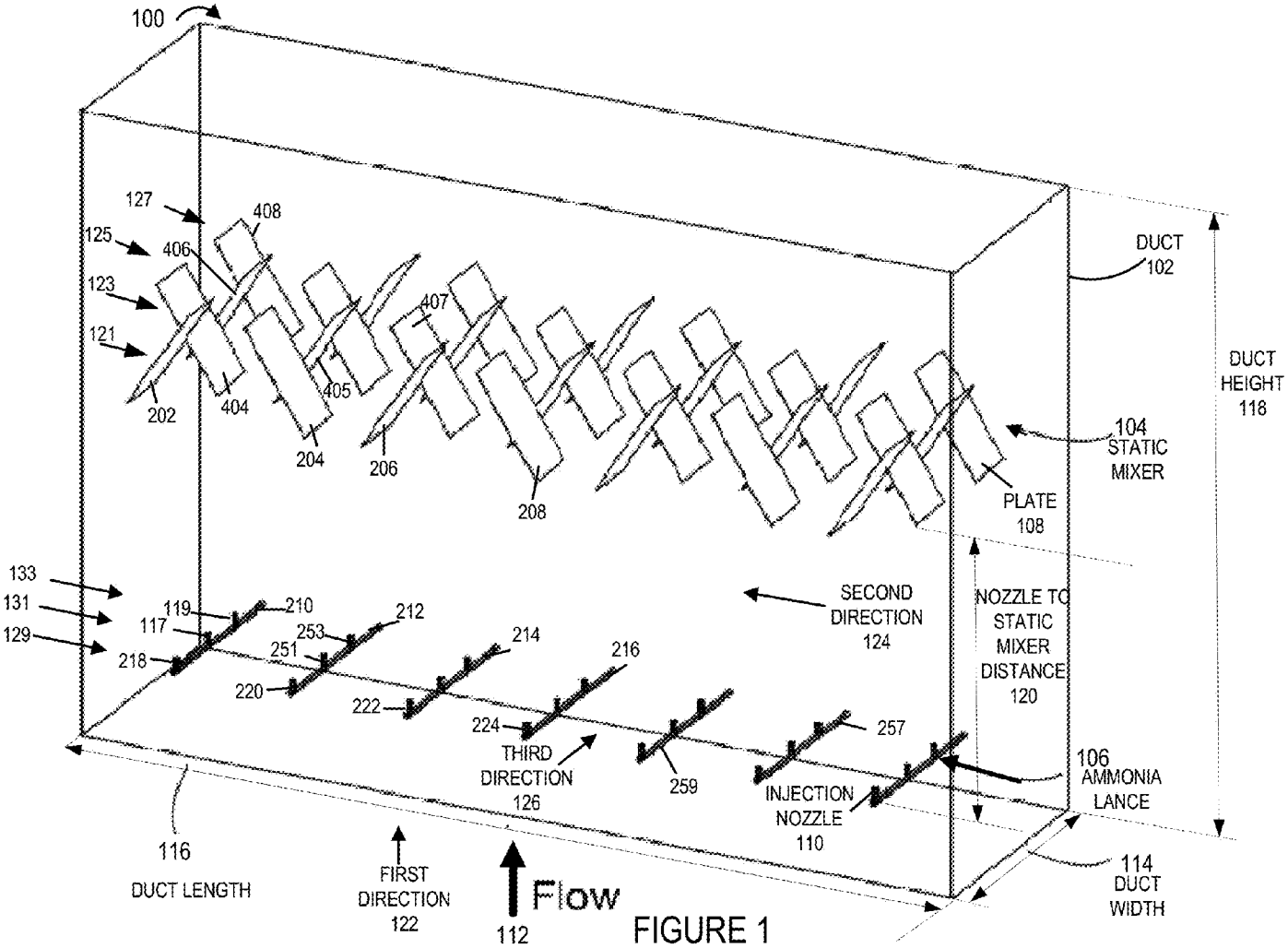
FIG. 1 is a drawing of an exemplary mixer assembly, which in the example includes a static mixer and a plurality of injection nozzles, configured in accordance with an exemplary embodiment.

FIG. 1 is a drawing of an exemplary mixer assembly 100 in accordance with an exemplary embodiment. Exemplary mixer assembly 100 includes a duct 102, a static mixer 104, and ammonia lances (210, 212, 214, 216, 259, 257, 106). The static mixer 104 includes rows of mixing plates (121, 123, 125, 127). The rows of mixing plates include a first row of mixing plates 121, a second row of mixing plates 123, a third row of mixing plates 125 and a fourth row of mixing plates 127. The ammonia lances (210, 212, 214, 216, 259, 257, 106) include injection nozzles, which are located within duct 102. Lance 210 includes injection nozzles (218, 117, 119). Lance 212 includes injection nozzles (220, 251, 253). Lance 214 includes exemplary injection nozzle 222. Lance 216 includes exemplary injection nozzle 224. Lance 106 includes exemplary injection nozzle 110. In various embodiments, the nozzles (218, 117, 119, 220, 251, 253, 253, 222, 224, 110) are gaseous injection nozzles for injecting a gaseous mixture into a flue gas.

In this example, there are four rows of mixing plates (121, 123, 125, 127), and each row of mixing plates includes 7 mixing plates. First row of mixing plates 121 includes plate 202, plate 204, plate 206 and plate 208. Second row of mixing plates 123 includes plate 404, plate 405, and plate 407. Third row of mixing plates 125 includes plate 406. Fourth row of mixing plates 127 includes plate 408 and plate 108.

There is a gas flow 112 through the duct 102. The ammonia injection lances (210, 212, 214, 216, 259, 257, 106) and nozzles (218, 117, 119, 220, 251, 253, 222, 224, 110) are located upstream of the static mixer 104. There is a nozzle to static mixer distance 120 between the injection nozzles of the lances and the plates of the static mixer 104.

In various embodiments, the ammonia injection lances (210, 212, 214, 216, 259, 257, 106) are located 4-10 ft (1.2-3 m) upstream of the static mixer 104. In some embodiments, the rows of nozzles are located in a range of 1.2 to 3 meters upstream from the first opening in the rows of mixing plates. In some embodiments, the first row of nozzles 129 is located in a range of 1.2 to 3 meters upstream from the first row of mixing plates 121. A preferred location for the ammonia injection lances is between 0.4 and 1 times the shortest dimension of the duct. The duct 102 has a duct width 114, a duct length 116, and a duct height 118. In this example, the duct width 114 is the shortest dimension of the duct 102. In one exemplary embodiment the ammonia injection lances are located upstream from the static mixer at a distance equal to 0.44 times the duct width. In another exemplary embodiment the ammonia injection lances are located upstream from the static mixer at a distance equal to 1.0 times the duct width.

Each lance has a number of small nozzles where the ammonia is injected into the gas stream. The number of nozzles can vary, but is most often related to the number of rows of mixing plates. In various embodiments, the number of nozzles per lance is either equal to or one less than the number of rows of mixing plates. In this example, there are 4 rows of mixing plates and 3 ammonia injection nozzles per lance.

The static mixer 104 features a series of angled plates facing opposite directions arranged in rows within the rectangular duct 102. The key feature of the plates is that, within a given row, every other plate is angled opposite of its neighbors. This is shown in further detail in the view of FIG. 2.

Three reference directions, first direction 122, second direction 124 and third direction 126, are shown. Duct 102 is configured to pass flue gas in the first direction 122. There are a plurality of rows mixing plates (121, 123, 125) in the duct 102, each row of mixing plates in the duct 102 extends in the second direction 124, and the second direction 124 is perpendicular to the first direction 122. Mixing plate row boundaries (510, 512, 514), illustrated in FIG. 5, occur in the third direction 126. The third direction 126 is perpendicular to the first direction 122 and the second direction 124. In this example, there are four rows of mixing plates (121, 123, 125, 127) and three row boundaries (510, 512, 514). There are a plurality of injection nozzles (218, 117, 119, 220, 251, 253, 222, 224, 110) positioned upstream of the mixing plates, and the nozzles (218, 117, 119, 220, 251, 253, 222, 224, 110) are arranged in rows (129, 131, 133) which are aligned in the third direction (126) with said row boundaries (510, 512, 514).

In this example, each row of nozzles (129, 131, 133) includes 7 nozzles, and there are 3 rows of nozzles (129, 131, 133).

In various embodiments, there are N rows of mixing plates and N-1 rows of nozzles. In the example of FIG. 1, there are 4 rows of mixing plates (121, 123, 125, 127) and 3 rows of nozzles (129, 131, 133).

Figure 2:
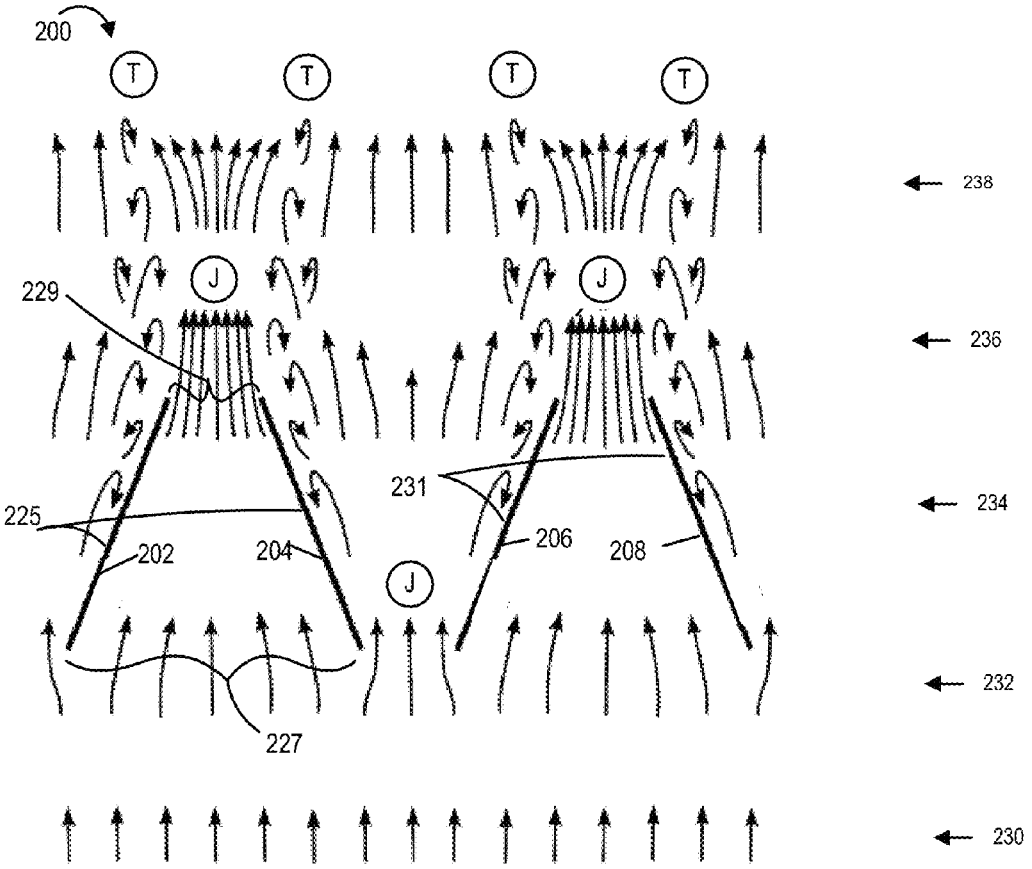
FIG. 2 is a drawing illustrating four successive exemplary injection nozzles aligned with a row of mixing plates which can be used in the mixer assembly of FIG. 1 and exemplary gas flow in accordance with an exemplary embodiment.
Figure 2:
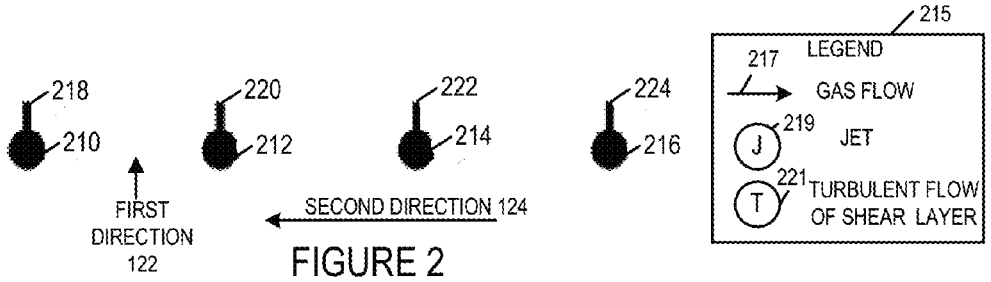

FIG. 2 is a drawing 200 illustrating four successive exemplary mixing plates (202, 204, 206, 208) in the first row of mixing plates 121 of mixer assembly 100 of FIG. 1. Drawing 200 also illustrates four exemplary lances (210, 212, 214, 216), and four exemplary ammonia injection nozzles (218, 220, 222, 224) aligned with the mixing plates (202, 204, 206, 208), respectively. The first row of mixing plates 121 includes a first plurality of pairs of angled mixing plates including a first angled pair of mixing plates 225 including mixing plate 202 and mixing plate and a second angled pair of mixing plates 231 including mixing plate 206 and mixing plate 208. The first angled pair of mixing plates 225 has a first upstream opening 227 and a first downstream opening 229, and the first downstream opening 229 is narrower than the first upstream opening 227.

Legend 215 indicates that small arrows 217 are used to represent gas flow; small circles with J 219 are used to indicate jet flow; and small circles with T 221 are used to indicate turbulent flow of shear layer. Region 230 is prior to entering the static mixer, upstream to the static mixer, in which the input gas flow is relatively uniform. Region 232 is the entry region to the static mixer. Region 234 is the region through the mixer. Region 236 is the exit region of the static mixer, and region 238 is downstream of the static mixer.

The opposing plate angles cause the flow to accelerate, as if through a nozzle or orifice, such that at the exit of the mixer these jets create a repeating pattern of low and high velocity zones. This high/low velocity behavior is depicted by the gas flow velocity vectors shown on FIG. 2. The interfaces between the high/low velocity zones are where significant shear forces are generated, mixing the flow along the row. Because of the opposing pattern of the plates in each row, the flow exiting the mixer remains aligned along the main duct direction. This is not the case in other shear-style mixers.

Figure 3:
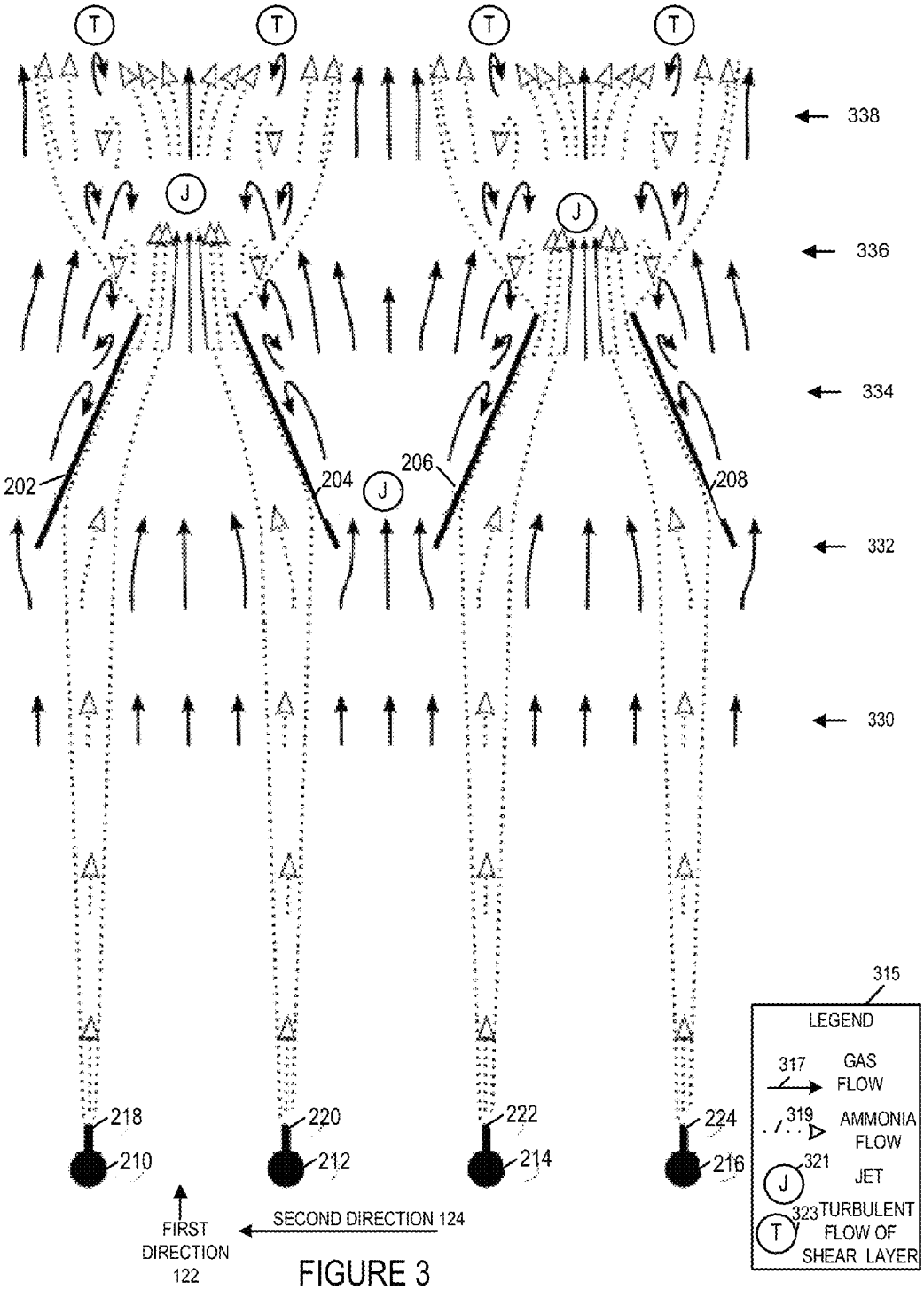
FIG. 3 is a drawing illustrating the four exemplary injection nozzles aligned with a row of mixing plates of FIG. 2 and exemplary gas flow being mixed with ammonia flow in accordance with an exemplary embodiment.

While the FIG. 2 drawing 200 shows how the duct velocity is influenced by the static mixer, FIG. 3 shows how the ammonia becomes thoroughly mixed with the main duct flow.

FIG. 3 is a drawing 300 illustrating the four successive exemplary mixing plates (202, 204, 206, 208) in a first row of mixing plates 121. Drawing 300 also illustrates the four exemplary lances (210, 212, 214, 216), and the four exemplary ammonia injection nozzles (218, 220, 222, 224) aligned with the mixing plates (202, 204, 206, 208), respectively. Legend 315 indicates that small solid arrows 317 are used to represent gas flow, and the dotted line arrows 319 are used to represent ammonia flow; small circles with J 321 are used to indicate jet flow; and small circles with T 323 are used to indicate turbulent flow of shear layer. Region 330 is prior to entering the static mixer, upstream to the static mixer, in which the input gas flow is relatively uniform. Region 332 is the entry region to the static mixer. Region 334 is the region through the mixer. Region 336 is the exit region of the static mixer, and region 338 is downstream of the static mixer.

In FIG. 3, the ammonia is injected upstream of the mixer. Due to basic turbulence and diffusion, it starts to spread and very gradually mix with the main duct flow. Upon passing through the mixer, however, the ammonia is drawn into the shear layers, and the extreme turbulence causes significant mixing and spreading of the ammonia. Exiting the mixer, the discrete jets from the nozzles are no longer apparent, and the ammonia is well-mixed into the main gas flow.

The newly-developed static mixer, e.g., mixer 104, has multiple rows (121, 123, 125, 127) of these plates. Four rows as shown in the example of FIG. 1, but the number can vary depending on the mixing needs and duct geometry.

Figure 4:
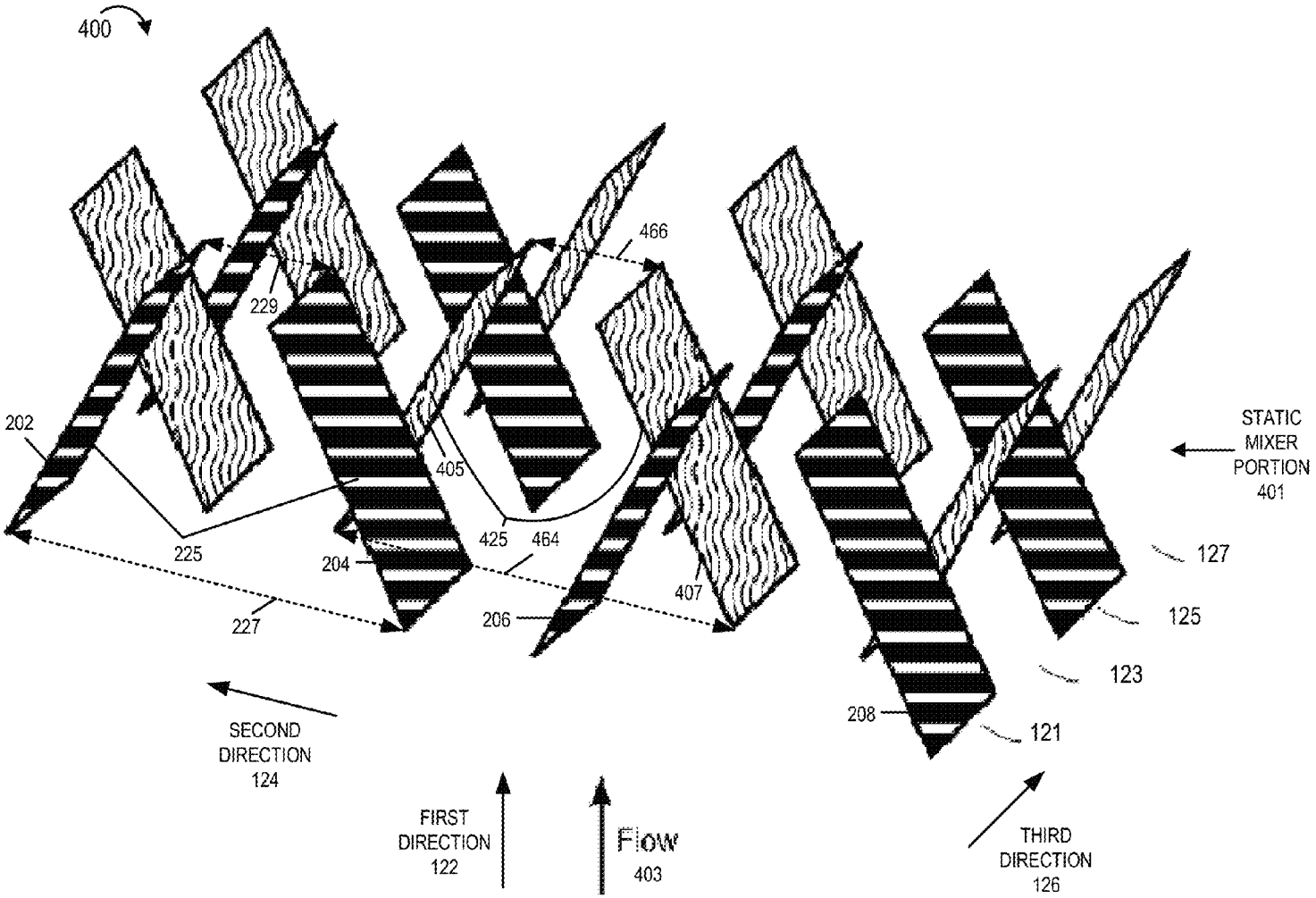
FIG. 4 is a drawing illustrating an exemplary portion of a static mixer including four rows of mixer plates in accordance with an exemplary embodiment.

FIG. 4 illustrates drawing 400 including an exemplary static mixer portion 401 including portion of the four rows of mixer plates (row 1 121, row 2 123, row 3 125, row 4 127) in accordance with an exemplary embodiment. Static mixer portion 401 is a portion of static mixer 104 of mixer assembly 100 of FIG. 1. First row 121, which includes a plurality of mixing plates, includes a first plurality of pairs of angled mixing plates including a first pair of angled mixing plates 225. The first pair of angled mixing plates 225 has a first upstream opening 227 in the second direction 124. The first pair of angled mixing plates 225 has a first downstream opening 229 in the second direction 124. The first downstream opening 229 is narrower than the first upstream opening 227.

Second row 123 includes second pair of angled mixing plates 425. The second pair of angled mixing plates 425 has a second upstream opening 464 in the second direction 124. The second pair of angled mixing plates 425 has a second downstream opening 466 in the second direction 124. The second upstream opening 464 is offset in said second direction 124 from the first upstream opening 227. The second downstream opening 466 is offset in said second direction 124 from the first downstream opening 229. In this example, the first and second downstream openings (229, 466) do not overlap in the second direction 124.

Drawing 400 further illustrates an exemplary gas flow 403. As shown in FIG. 4, the relative position of the angled plates of each row are offset from the plates of the adjacent rows. This provides an offset of the high/low velocity jets such that they are staggered over the duct cross section. This creates additional shear layers between the rows, depicted by the velocity vectors shown in the side view of the duct, illustrated in FIG. 5.

Figure 5:
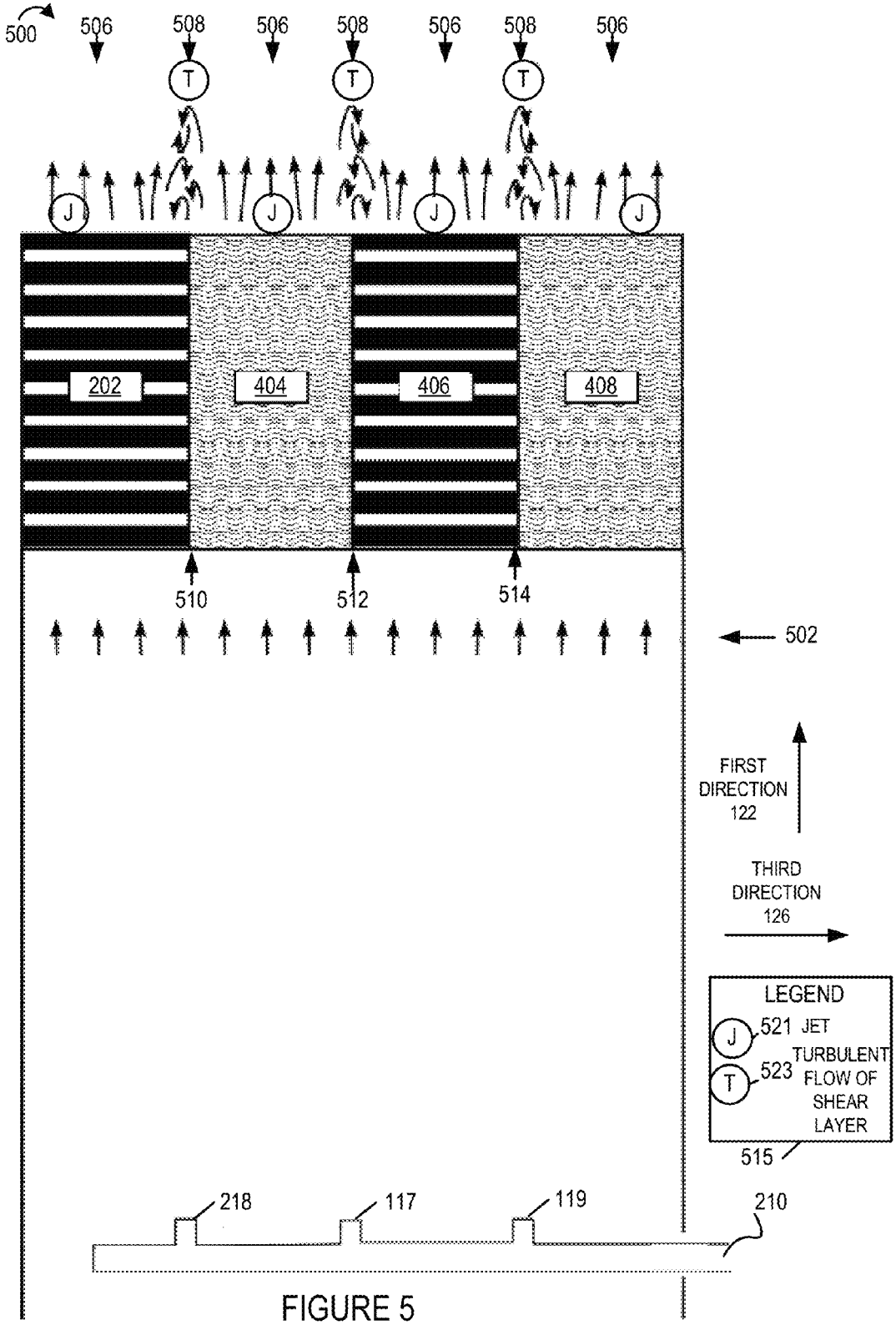
FIG. 5 illustrates a side view of the static mixer portion of FIG. 4 illustrating a mixer plate from each of 4 rows of mixer plates and an ammonia injection lance with 3 ammonia injection nozzles positioned at row boundaries in accordance with an exemplary embodiment.

Drawing 500 of FIG. 5 illustrates a side view of the static mixer portion of FIG. 4 illustrating the mixer plates (202, 404, 406, 408) from the four rows of mixer plates (121, 123, 125, 127) and further includes ammonia injection lance 210 with 3 ammonia injection nozzles (218, 117, 119). Arrows 502 illustrate gas flow entering the static mixer. Arrows 506 illustrate gas flow exiting the mixer in regions away from row boundaries. Arrows 508 illustrate gas flow exiting the static mixer in boundary regions where additional shear layers between the rows exist.

Legend 515 indicates small circles with J 521 are used to indicate jet flow; and small circles with T 523 are used to indicate turbulent flow of shear layer.

Nozzle 218, which is part of the first row of nozzles 129, is located at the row boundary 510 between the first and second rows of plates (121, 123). The first row of plates 121 includes plate 202 and the second row of plates 123 includes plate 404. Nozzle 218 is located at the point in the second dimension, i.e. second direction 124, where a plate 202 of the first angled pair of mixing plates 225 crosses an angled mixing plate 404 of the second row of mixing plates 123. The crossing of the plates (202, 404) is shown in FIG. 1 and also in FIG. 4.

Nozzle 117, which is part of the second row of nozzles 131, is located at the row boundary 512 between the second and third rows of plates (123, 125). The second row of plates 123 includes plate 404 and the third row of plates 125 includes plate 406. Nozzle 119, which is part of the third row of nozzles 133, is located at the row boundary 514 between the third and fourth rows of plates (125, 127). The third row of plates 125 includes plate 406 and the fourth row of plates 127 includes plate 408.

Figure 6:
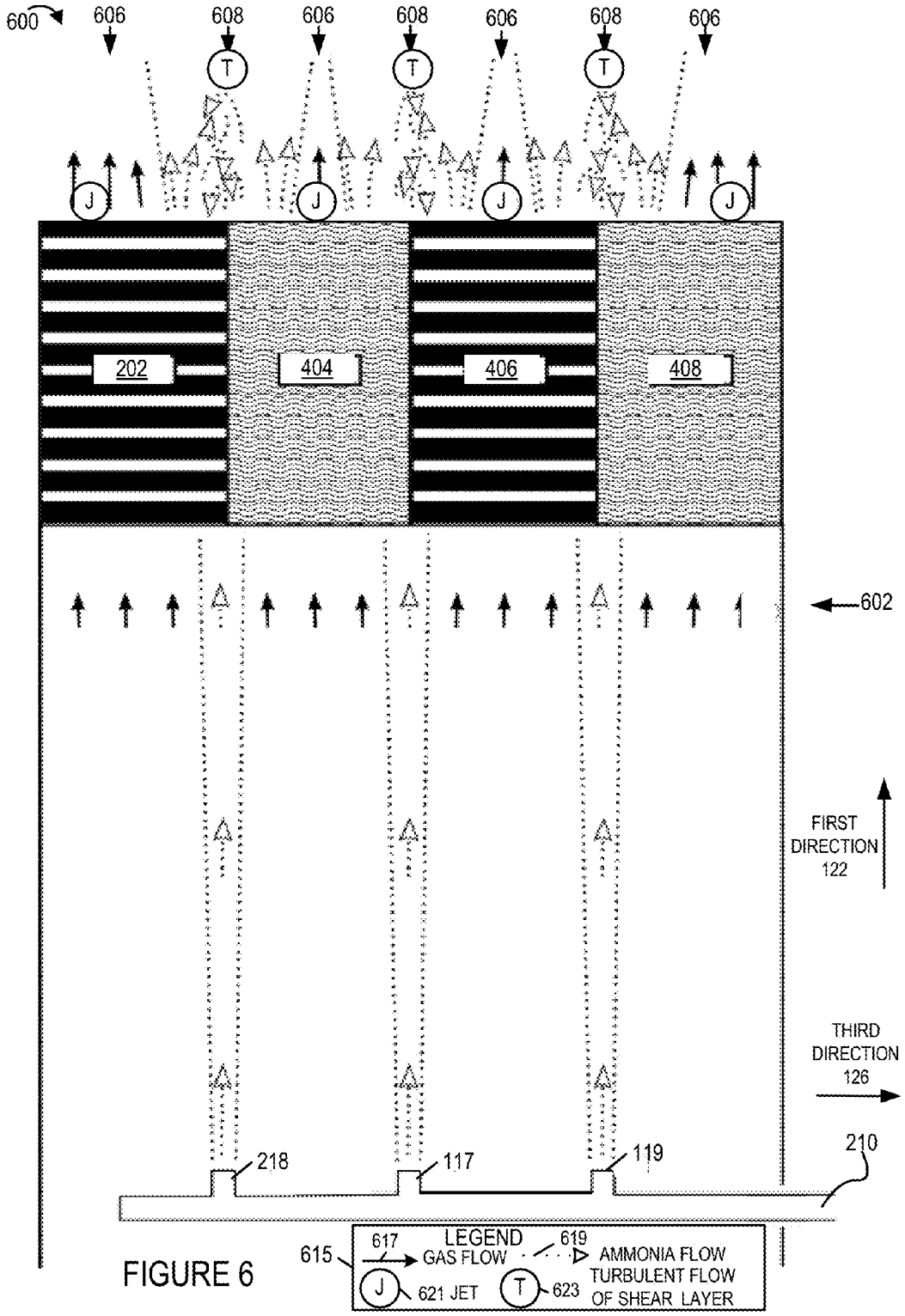
FIG. 6 illustrates the elements shown in FIG. 5 including a mixer plate from each of four rows of mixer plates, an ammonia injection lance with nozzles, and further illustrates both gas flow and ammonia flow.

FIG. 6 illustrates the elements shown in FIG. 5 including mixer plates (202, 404, 406, 408), ammonia injection lance 210 and nozzles (218, 117, 119), and further illustrates both gas flow and ammonia flow. Legend 615 indicates that small solid line arrows 617 indicate gas flow and dotted line arrows 619 indicate ammonia flow; small circles with J 621 are used to indicate jet flow; and small circles with T 623 are used to indicate turbulent flow of shear layer. FIG. 6 indicates the preferred positioning of the ammonia injection lances and nozzles with respect to the mixing plates in the side view. Typically, in various embodiments, the nozzles are not spaced on equal area segments of the duct, as most injection systems are. Instead, in accordance with a feature of some embodiments, the nozzles of the lances are aligned directly below the shear layers created by the static mixer plates. This has been found to generate the most beneficial mixing of ammonia with the NOx. Note that the ammonia flow is a relatively narrow flow directed on the row boundary areas of the static mixer, corresponding to row boundaries (510, 512, 514) shown in FIG. 5.

Region 602 illustrate gas flow and ammonia flow entering the static mixer. Regions 606 illustrate flow exiting the mixer in regions away from row boundaries. Regions 608 illustrate flow exiting the static mixer in boundary regions where additional shear layers between the rows exist.

As indicated in FIG. 6 (like FIG. 3), the ammonia diffuses slowly from the nozzle to the mixer. Passing through the mixer, however, the ammonia expands and mixes significantly as it is entrained in the shear layers.

Figure 7:
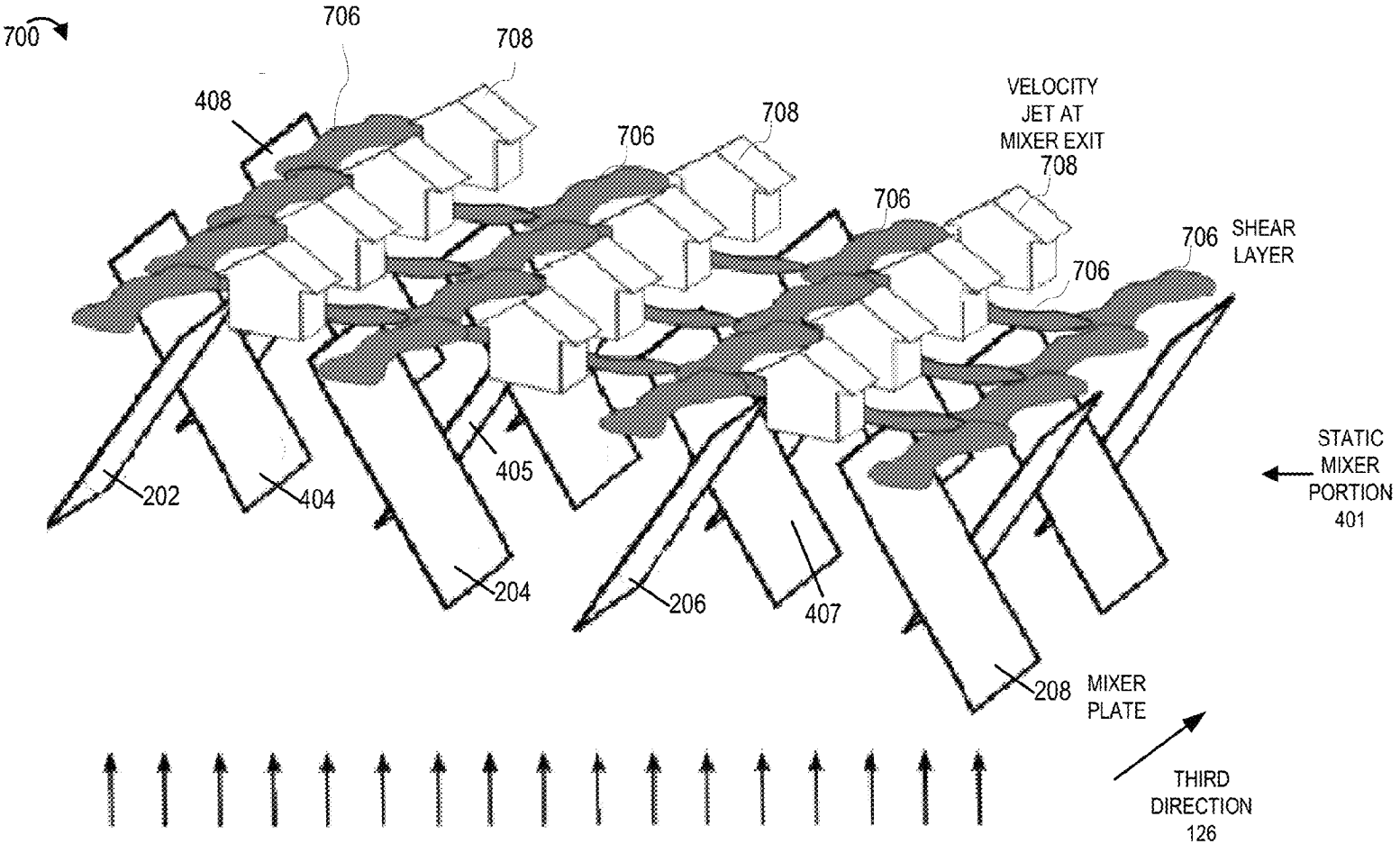
FIG. 7 illustrates an exemplary portion of a static mixer, an input gas flow to the static mixer, exemplary velocity jets exiting the static mixer, and exemplary shear layers.

Combining the effects in the length-wise direction, as illustrated in FIGS. 2 and 3, and the width-wise direction, as illustrated in FIGS. 5 and 6, the newly-developed mixer provides coverage of the full cross section. Shear layers resulting from the staggered jets exist in both the length and width directions, promoting mixing in both directions with a single stage of mixer. The shear layers promote mixing by generating the re-circulating flow zones and turbulence shown in FIGS. 2, 4, and 5. FIG. 7 shows the velocity and shear layers, and FIG. 8 shows the ammonia mixing.

Drawing 700 of FIG. 7 illustrates exemplary static mixer portion 401 of mixer 104 of mixer assembly 100 including plates (202, 204, 206, 208, 404, 405, 407, 408), input gas flow 702 to the static mixer, exemplary velocity jets 708 exiting the static mixer and exemplary shear layers 706.

Figure 8:
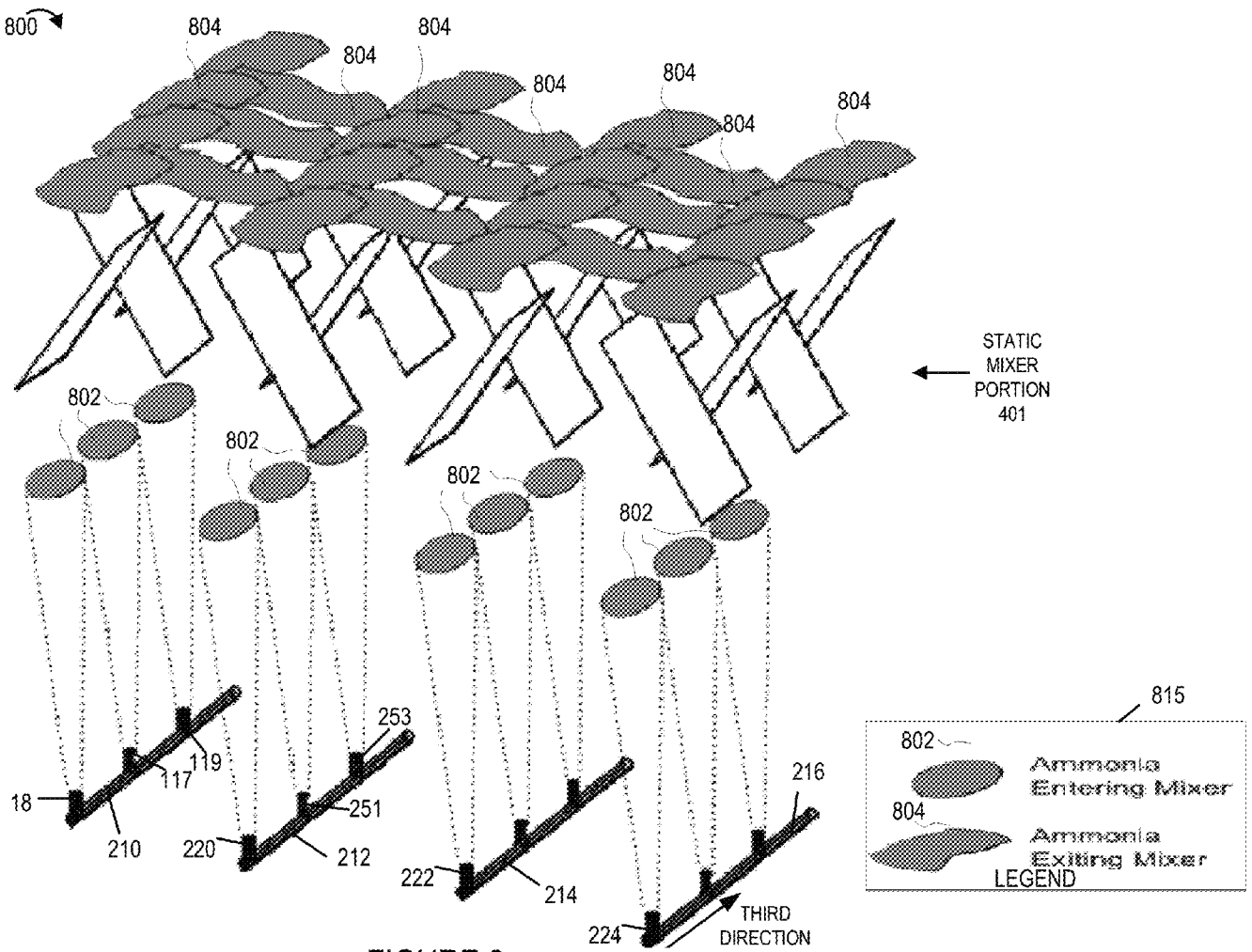
FIG. 8 illustrates an exemplary portion of a mixer assembly, ammonia entering the mixer, and ammonia exiting the mixer in accordance with an exemplary embodiment.

FIG. 8 is a drawing 800 illustrating the exemplary static mixer portion 401 and a corresponding set of exemplary injection lances (210, 212, 214, 216) and nozzles including nozzles 218, 117, 119, 220, 251, 253, 222, and 224. Drawing 800 further illustrates ammonia flow. Legend 815 indicates that ammonia entering the mixer is illustrated by small oval patterns 802, and ammonia exiting the mixer is illustrated by dispersed patterns 804.

Some but not all preferred embodiments of the newly-developed static mixer have between 2 and 6 rows of plates. The number of rows, along with the number of plates per row, depends on the duct dimensions and can differ depending on the embodiment. The angle of the opposing plates that form the velocity jets and shear layers is generally in the range of 20-45 degrees (measured from the flow direction). Larger angles are possible, but this further accelerates the flow, which can result in adverse effects such as high pressure drop or particulate erosion of downstream structural elements. The shape of the plates is generally rectangular for simplicity of fabrication and structural support, but other shapes are possible if different mixing needs exist.

Figure 9:
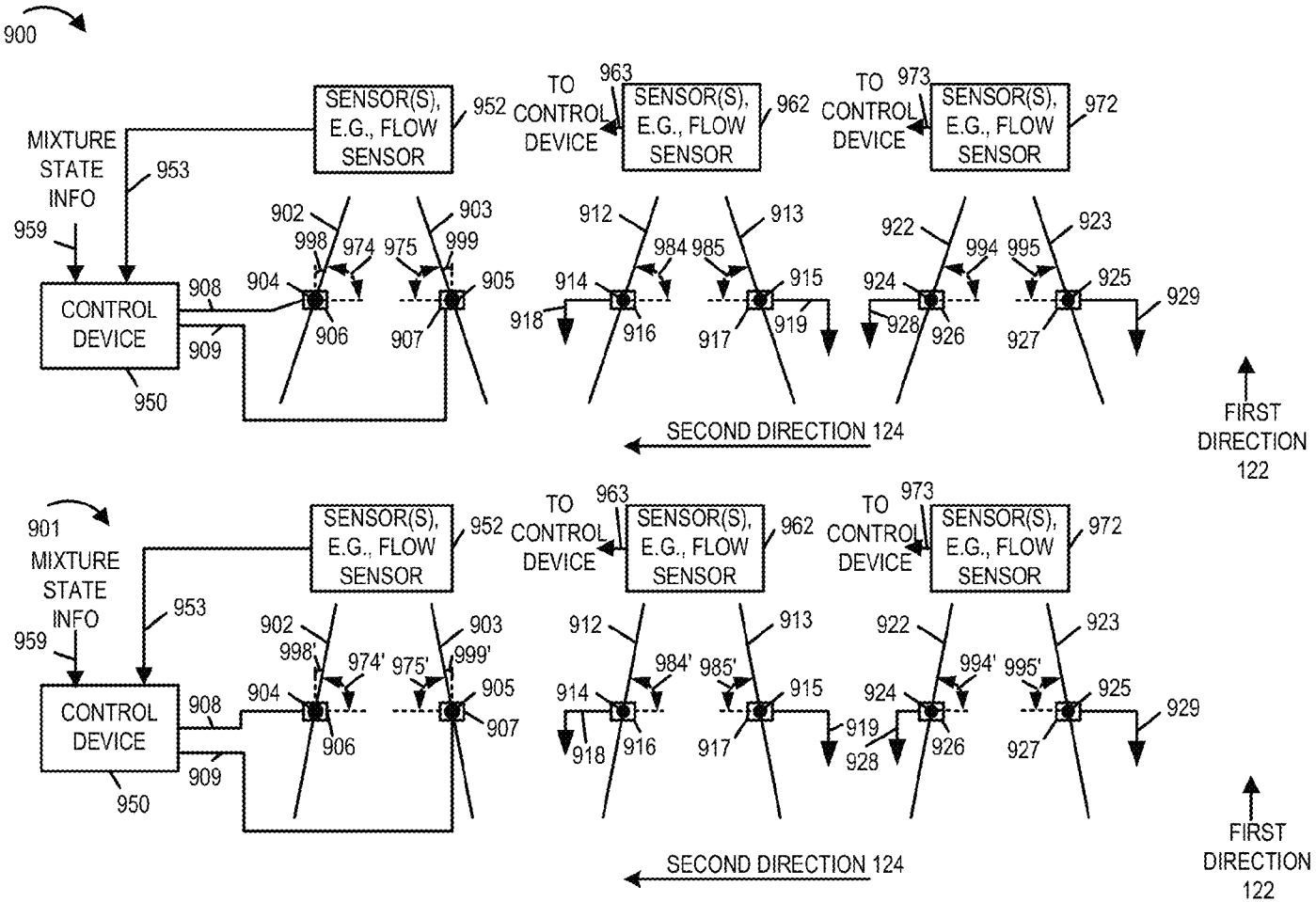
FIG. 9 illustrates an exemplary design for a row or portion of a row of a mixer in which mixer plates are mounted on movable pivots, which may be controlled in response to sensor information and/or mixture state information, in accordance with an exemplary embodiment.

FIG. 9 illustrates an exemplary design for a row or portion of a row of a mixer in which mixer plates are mounted on movable pivots in accordance with an exemplary embodiment. The exemplary mixer with mixer plates mounted on moveable pivots may be included in a mixer assembly, such as, e.g., mixer assembly 100 of FIG. 1 in place of static mixer 104. For example, the mixer assembly with mixer plates with moveable pivots, incorporating the design of FIG. 9, may have the same number of plates as static mixer assembly 104, but with the plates mounted on moveable pivots, and with the ammonia injection nozzles in the same mounting position.

Drawing 900 of FIG. 9 illustrates the moveable plates positioned in a first controlled configuration, and drawing 901 of FIG. 9 illustrates the moveable plates in a second controlled configuration. Drawing 900 illustrates pairs of mixer plates ((902, 903), (912, 913), (922, 923)) mounted on corresponding moveable pivots ((904, 905), (914, 915), (924, 925)), and corresponding position sensors/motor assemblies ((906, 907), (916, 917), (926, 927)), and corresponding sensor(s) (952, 962, 972), respectively.

In some embodiments, the sensors (952, 962, 972) are flow sensors for measuring the flow rate of the flue gas. In this example, there is one sensor per pair of plates; however, in other embodiments, a different number of sensors are used, e.g., one flow sensor for the entire mixer, one flow sensor per row of the mixer, one flow sensor upstream of the mixer and one flow sensor downstream of the mixer, multiple flow sensors upstream of the mixer and multiple flow sensors downstream of the mixer, etc.

Control device 950 is used for varying the angle of plates as a function of flue gas flow and/or mixture state information 959. Sensors (952, 962, 972) are coupled to the control device 950 via links (953, 963, 973), respectively, via which control device 950 receives flue gas flow information and/or other sensor output information. Control device 950 is coupled to position sensors/motor assemblies (906, 907, 916, 917, 926, 927), via links (908, 909, 918, 919, 928, 929), respectively via which the control device 950 controls the moveable pivots (906, 907, 916, 917, 926, 927), respectively, to control the angular position of the mixing plates (902, 903, 912, 913, 922, 923), respectively.

In the example, shown in drawing 900 of FIG. 9, angle 974, angle 975, angle 984, angle 985, angle 994 and angle 995 are the same. In the example, shown in drawing 901 of FIG. 9, angle 974', angle 975', angle 984', angle 985', angle 994' and angle 995' are the same, and angle 994 is different from angle 994'. In some embodiments, different pairs of plates in the mixer may be, and sometimes are controlled to be positioned at different angles at the same time. In some embodiments, each plate in a pair of plates may be controlled to be at a different angle at the same time, e.g., a slightly different angle to fine tune the mixing in response to sensor measurements and/or mixture state information.

As shown in FIG. 9, the controlled angles formed by a pair of mixing plates, e.g., angle 974 and angle 975, are generally in the range of 45 degrees to 70 degrees. For example angles (974, 975) may be 60 degrees, and angles (974' 975') may be 70 degrees.

Alternatively, if the plate angles were specified with respect to the flow direction, e.g., first direction 122, the angles are generally in the range of 20 degrees to 45 degrees. For example, angles (998' and 999') may be 20 degrees and angles (998 and 999) may be 30 degrees.

Figure 10:
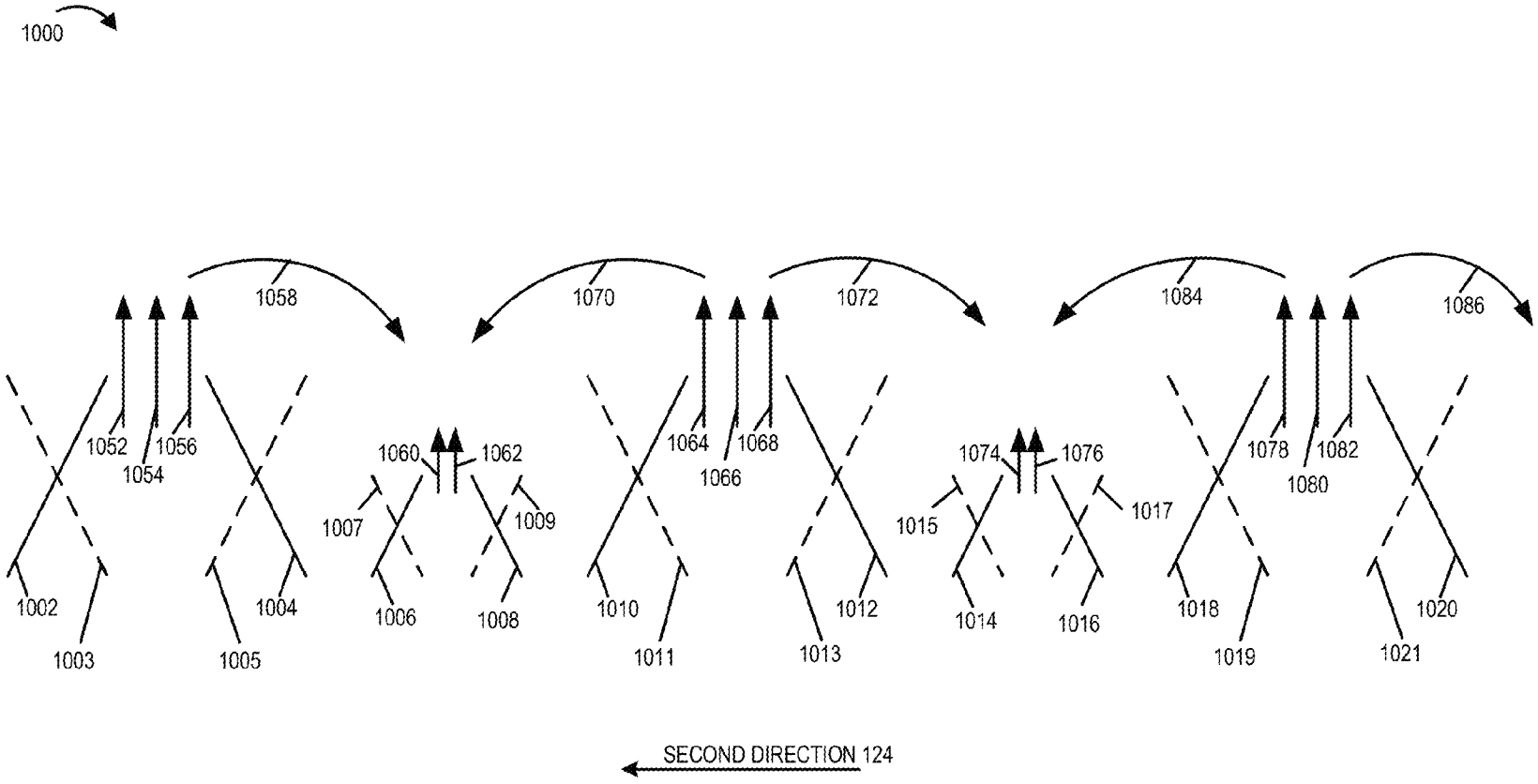
FIG. 10 includes a drawing which illustrates an exemplary design for two rows or portions of two rows of a mixer in which pairs of mixer plates are of different sizes in accordance with an exemplary embodiment.

FIG. 10 includes drawing 1000 which illustrates an exemplary design for two rows or portions of two rows of a mixer in which pairs of mixer plates are of different sizes in accordance with an exemplary embodiment. The exemplary mixer with mixer plates of different sizes may be included in a mixer assembly, such as, e.g., mixer assembly 100 of FIG. 1 in place of static mixer 104 which has uniform size mixer plates. For example, the mixer assembly with pairs of mixer plates, incorporating the design of FIG. 10, may have the same number of plates as static mixer assembly 104, but with pairs of plates of different sizes, and with the ammonia injection nozzles in the same mounting position.

A first row of mixer plates, represented by solid lines, in the mixer includes mixer plate pairs (1002, 1004), (1006, 1008), (1010, 1012), (1014, 1016), (1018, 1020). A second row of mixer plates, represented by dashed lines, in the mixer includes mixer plate pairs (1003, 1005), (1007, 1009), (1011, 1013), (1015, 1017), (1019, 1021). Arrows (1052, 1054, 1056, 1058, 1060, 1062, 1064, 1066, 1068, 1070, 1072, 1074, 1076, 1078, 1080, 1082, 1084, 1086) illustrate some exemplary gas flow with regard to the first row of the mixer.

The first row of mixing plates includes pairs of mixing plates of at least two different sizes, said pairs of mixing plates of different sizes including a first pair of mixing plates (1002, 1004) of a first size and a second pair of mixing plates (1006, 1008) of a second size, and the second size is smaller than the first size.

Figure 11:
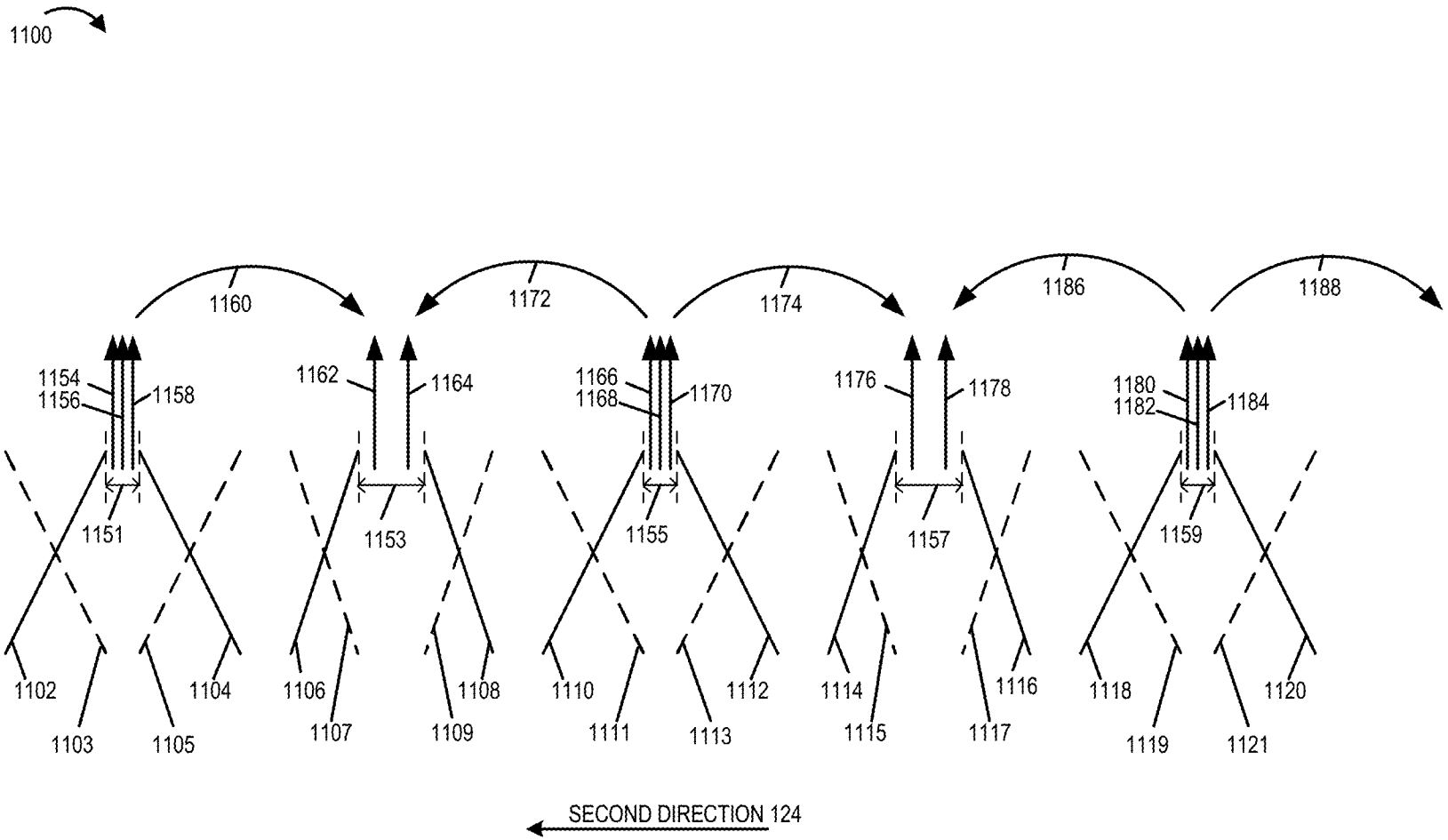
FIG. 11 includes a drawing which illustrates an exemplary design for two rows or portions of two rows of a mixer in which pairs of mixer plates are positioned at different angles in accordance with an exemplary embodiment.

FIG. 11 includes drawing 1100 which illustrates an exemplary design for two rows or portions of two rows of a mixer in which pairs of mixer plates are positioned at different angles in accordance with an exemplary embodiment. This approach results in different exit size corresponding to different pairs of mixing plates. The exemplary mixer with pairs of mixer plates at different angles may be included in a mixer assembly, such as, e.g., mixer assembly 100 of FIG. 1 in place of static mixer 104. For example, the mixer assembly with pairs of mixer plates, incorporating the design of FIG. 11, may have the same number of plates as static mixer assembly 104, but with different pairs of plates positioned to different angles, and with the ammonia injection nozzles in the same mounting position.

A first row of mixer plates, represented by solid lines, in the mixer includes mixer plate pairs (1102, 1104), (1106, 1108), (1110, 1112), (1114, 1116), (1118, 1120). A second row of mixer plates, represented by dashed lines, in the mixer includes mixer plate pairs (1103, 1105), (1107, 1109), (1111, 1113), (1115, 1117), (1119, 1121). Arrows (1154, 1156, 1158, 1160, 1162, 1164, 1166, 1168, 1170, 1172, 1174, 1176, 1178, 1180, 1182, 1184, 1186, 1188) illustrate some exemplary gas flow with regard the first row of the mixer.

The exit width for plate pairs (1102, 1104), (1106, 1108), (1110, 1112), (1114, 1116), (1118, 1120) is represented by distances (1151, 1153, 1155, 1157, 1159), respectively. Plate pairs (1102, 1104), (1110, 1112), (1118, 1120) are set to a first angle value, and plate pairs (1106, 1108), (1114, 1116) are set to a second angle value which is different from the first angle value. Distances 1151, 1155 and 1159 are the same; distances 1153 and 1157 are the same, and distance 1151 is less than distance 1153.

The newly-developed flow mixing device, in accordance with some embodiments is well suited for NH3 and NOx mixing in SCR systems, e.g., at power plants and/or industrial facilities. The mixing assembly includes, in at least some embodiments, both the injection lances with injection nozzles included therein or mounted thereon and the static mixer. The static mixer includes a plurality of rows of mixing plates positioned in relationship to the injection nozzles in a way that provides a high degree of mixing, e.g., using fewer rows of nozzles than rows of mixing plates.

However, there are other applications for the newly developed static mixer alone, without the ammonia injection lances and thus the invention is not necessarily limited to the combination of lances and mixing plates. The static mixer, in accordance with features of the present invention can provide shear mixing and turbulence to promote temperature mixing, e.g., mixing of flue gas that varies in temperature, for SCRs.

What is claimed is:

1. A mixer assembly, comprising:

a duct configured to pass flue gas in a first direction, said first direction being a downstream direction;

a plurality of rows of mixing plates in said duct, each row of mixing plates extending in a second direction in said duct, mixing plates in said rows of mixing plates each having an upstream end and a downstream end and being supported at a location between said upstream end and said downstream end, said second direction being perpendicular to said first direction, said plurality of rows of mixing plates forming a set of consecutive rows of mixing plates, each consecutive row being at a different location in a third direction, said third direction extending perpendicular to said first and second directions, a mixing plate row boundary, extending parallel to the rows of mixing plates, occurring in the third direction between each pair of adjacent rows of mixing plates in said set of consecutive rows of mixing plates, adjacent mixing plates in a first row of mixing plates alternating in angle with respect to the second direction, a first mixing plate in said first row being adjacent a first mixing plate in a second row of mixing plates in said plurality of rows of mixing plates and having a different angle with respect to the second direction than the first mixing plate in the second row; and a plurality of gas injection nozzles, positioned upstream of said rows of mixing plates, said nozzles being arranged in rows which are aligned in said third direction with mixing plate row boundaries.

2. The mixer assembly of claim 1, wherein said first row of mixing plates includes a first plurality of pairs of angled mixing plates, including a first pair of angled mixing plates, said first pair of angled mixing plates having a first upstream opening and a first downstream opening, said first downstream opening being narrower than said first upstream opening.

3. The mixer assembly of claim 2, wherein said second row of mixing plates includes at least a second pair of angled mixing plates located in said second direction adjacent said first pair of angled mixing plates, said second pair of angled mixing plates having a second upstream opening and a second downstream opening, said second upstream opening being offset in said second direction from the first upstream opening.

4. The mixer assembly of claim 3, wherein said first and second downstream openings do not overlap in said second direction.

5. The mixer assembly of claim 4, wherein a first nozzle of a first row of nozzles is located at the row boundary between said first and second rows of plates.

6. The mixer assembly of claim 5, wherein said first nozzle is located at the point in said second dimension where a plate of said first pair of angled mixing plates crosses an angled mixing plate of said second row of mixing plates.

7. The mixer assembly of claim 6, wherein said first and second rows of mixing plates include pairs of mixing plates which are offset from one another in the second direction by an amount sufficient for at least some angled mixing plates of said first row of mixing plates to cross angled mixing plates of said second row; and wherein nozzles in said rows of nozzles located along said row boundaries are positioned in said second direction to coincide with the locations in the second direction where mixing plates of said first row of angled mixing plates cross mixing plates of said second row of angled mixing plates.

8. The mixer assembly of claim 6, wherein there are N rows of mixing plates and N-1 rows of nozzles.

9. The mixer assembly of claim 6, wherein the nozzles are gaseous injection nozzles for injecting a gaseous mixture into a flue gas.

10. The mixer assembly of claim 6, wherein said first row of nozzles is located in a range of 1.2 to 3 meters upstream from the first row of mixing plates.

11. The mixer assembly of 6, wherein said first row of mixing plates includes pairs of mixing plates of at least two different sizes, said pairs of mixing plates of different sizes including a first pair of mixing plates of a first size and a second pair of mixing plates of a second size, said second size being smaller than said first size.

12. A mixer assembly, comprising:

a duct configured to pass flue gas in a first direction;

a plurality of rows of mixing plates in said duct, mixing plates in said rows of mixing plates each having an upstream end and a downstream end and being supported at a location between said upstream end and said downstream end, each row of mixing plates extending in a second direction in said duct, said second direction being perpendicular to said first direction, said plurality of rows of mixing plates forming a set of consecutive rows of mixing plates, each consecutive row being at a different location in a third direction, said third direction extending perpendicular to said first and second directions, a mixing plate row boundary, extending parallel to the rows of mixing plates, occurring in the third direction between each pair of adjacent rows of mixing plates in said set of consecutive rows of mixing plates, adjacent mixing plates in a first row of mixing plates alternating in angle with respect to the second direction, a first mixing plate in said first row being adjacent a first mixing plate of a second row of mixing plates in said plurality of rows of mixing plates and having a different angle with respect to the second direction than the first mixing plate of the second row; and a plurality of gas injection nozzles, positioned upstream of said rows of mixing plates, said nozzles being arranged in rows which are aligned in said third direction with mixing plate row boundaries;

wherein said first row of mixing plates includes a first plurality of pairs of angled mixing plates including a first pair of angled mixing plates, said first pair of angled mixing plates having a first upstream opening and a first downstream opening, said first downstream opening being narrower than said first upstream opening;

wherein said second row of mixing plates includes at least a second pair of angled mixing plates located in said second direction adjacent said first pair of angled mixing plates, said second pair of angled mixing plates having a second upstream opening and a second downstream opening, said second upstream opening being offset in said second direction from the first upstream opening;

wherein said first and second downstream openings do not overlap in said second direction;

wherein a first nozzle of a first row of nozzles is located at the row boundary between said first and second rows of mixing plates;

wherein said first nozzle is located at the point in said second direction where a plate of said first pair of angled mixing plates crosses an angled mixing plate of said second row of mixing plates;

wherein said mixing plates are mounted on movable pivots; and wherein the mixer assembly further includes a control device for varying the angle of plates as a function of flue gas flow.

13. The mixer assembly of claim 12, further comprising:

a flow sensor for measuring the flow rate of said flue gas.

14. The mixer assembly of claim 1, wherein said mixing plates are flat rectangular mixing plates; and wherein the mixing plates are supported at a midpoint of the flat rectangular mixing plates.

15. The mixer assembly of claim 1, wherein said mixing plates are mounted on movable pivots; and wherein the mixer assembly further includes:

a control device for varying the angle of plates as a function of flue gas flow measured by a flow sensor.

16. The mixer of claim 14, wherein said mixer includes a single stage including said plurality of rows of mixing plates which cause mixing in both the second and third directions within the single stage.

17. The mixer of claim 1, wherein adjacent plates in the first row extending in the second direction alternate in angle with respect to the second direction; and wherein adjacent plates in a row of plates extending in the third direction alternate in angle with respect to the second direction, said row of plates extending in the third direction including a single plate from said first row of plates extending in the second direction.

18. The mixer assembly of claim 1, wherein said plates form an array of plates including rows of plates extending in the third direction in addition to rows of plates extending in said second direction, wherein adjacent plates within each row extending in the second direction alternate in angle with respect to the second direction; and wherein adjacent plates within each row extending in the third direction alternate in angle with respect to the second direction.

19. The mixer assembly of claim 18, wherein the plates in the rows extending in the second direction and the plates in the rows extending in the third direction are rectangular plates.

20. The mixer assembly of claim 19, wherein the plates in the rows extending in the second direction and the plates in the rows extending in the third direction are the same size.

* * * * *